United States Patent [19]

Stringham

[11] Patent Number: 5,052,560

[45] Date of Patent: Oct. 1, 1991

[54] CONFECTION HOLDING STRUCTURE FOR USE IN ENVELOPES

[76] Inventor: Richard B. Stringham, 522 E. First South, Salt Lake City, Utah 84102

[21] Appl. No.: 588,709

[22] Filed: Sep. 27, 1990

[51] Int. Cl.[5] ..... B65D 1/36; B65D 27/02

[52] U.S. Cl. ..... 206/564; 206/587; 206/592; 206/815; 229/904.1; 229/68 R

[58] Field of Search ..... 206/592, 594, 587, 564, 206/815; 229/904.1, 68 R

[56] References Cited

U.S. PATENT DOCUMENTS 3,305,086 2/1967 Hartman, Jr. ..... 206/592

FOREIGN PATENT DOCUMENTS 1112007 7/1961 Fed. Rep. of Germany ... 229/904.1

928113 6/1963 United Kingdom ..... 206/564

*Primary Examiner*—William I. Price

*Attorney, Agent, or Firm*—Thorpe, North & Western

[57] ABSTRACT

A confection holding structure for disposition in greeting cards and greeting card envelopes includes a generally planar sheet of material having a plurality of relatively shallow recesses formed in one surface thereof to define open receptacles for receiving and holding confections, where such confections have thicknesses and parimetric shapes which generally conform to the depths and shapes of corresponding receptacles. The sheet of material also includes downwardly projecting support protuberances located generally adjacent to at least some of the receptacles to thereby provide support for inhibiting the crushing or deformation of the receptacles and confections contained therein when, for example, an envelope containing the holding structure is passed through a stamp cancelling machine.

20 Claims, 1 Drawing Sheet

CONFECTION HOLDING STRUCTURE FOR USE IN ENVELOPES

BACKGROUND OF THE INVENTION

The present invention relates to a confection holding tray for use in conventional greeting card envelopes.

Greeting cards have been used for many years to acknowledge special occasions such as birthdays, anniversaries, and various holidays. Typically the greeting card will contain a message for the benefit of the recipient, although greeting card structures have been proposed for carrying gifts, flowers or other foliage, and even musical messages. See, for example, U.S. Pat. Nos. 4,584,213, 4,840,275, 2,314,721, 3,259,236, 4,217,982, 2,796,985, 4,203,516, 4,440,298, 4,484,768 and 1,011,697.

One problem with designing greeting card packages for containing gifts or other items is that of providing a package sufficiently thin to enable insertion into a conventional envelope while at the same time reinforcing the package so that the gift or other item will not be crushed either in the stamp cancelling machinery or in any stage of the delivery process. Also, such packaging should be fairly lightweight to minimize the cost of mailing.

SUMMARY OF THE INVENTION

It is an object of the invention to provide a confection holding structure suitable for disposition in a foldable greeting card and greeting card envelope.

It is also an object of the invention to provide such a structure which serves to both hold confections and other items and prevent the items from being crushed or damaged.

It is a further object of the invention to provide such a structure which, when inserted into a conventional envelope, will not impede processing of the envelope in a stamp cancelling machine.

It is an additional object of the invention to provide such a structure which is simple in construction and easy to manufacture.

The above and other objects are realized in a specific illustrative embodiment of a mailing card/confection tray which includes a sheet of material having a generally planar upper surface formed with one or more relatively shallow recesses or receptacles, each having sidewalls which extend downwardly from the upper surface, and a bottom wall which is generally parallel with and below the upper surface. The recesses are shaped to hold a confection or other gift item so that the top of the item is generally flush with the upper surface of the sheet of material. Downwardly projecting support protuberances are formed in the sheet of material generally adjacent at least some of the receptacles to provide support for inhibiting the crushing of the receptacles.

In accordance with one aspect of the invention, the edges of the sheet of material are tapered outwardly and downwardly from the upper surface to allow easy insertion of the sheet into an envelope and to allow ready movement of an envelope containing the sheet through a stamp cancellation machine.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
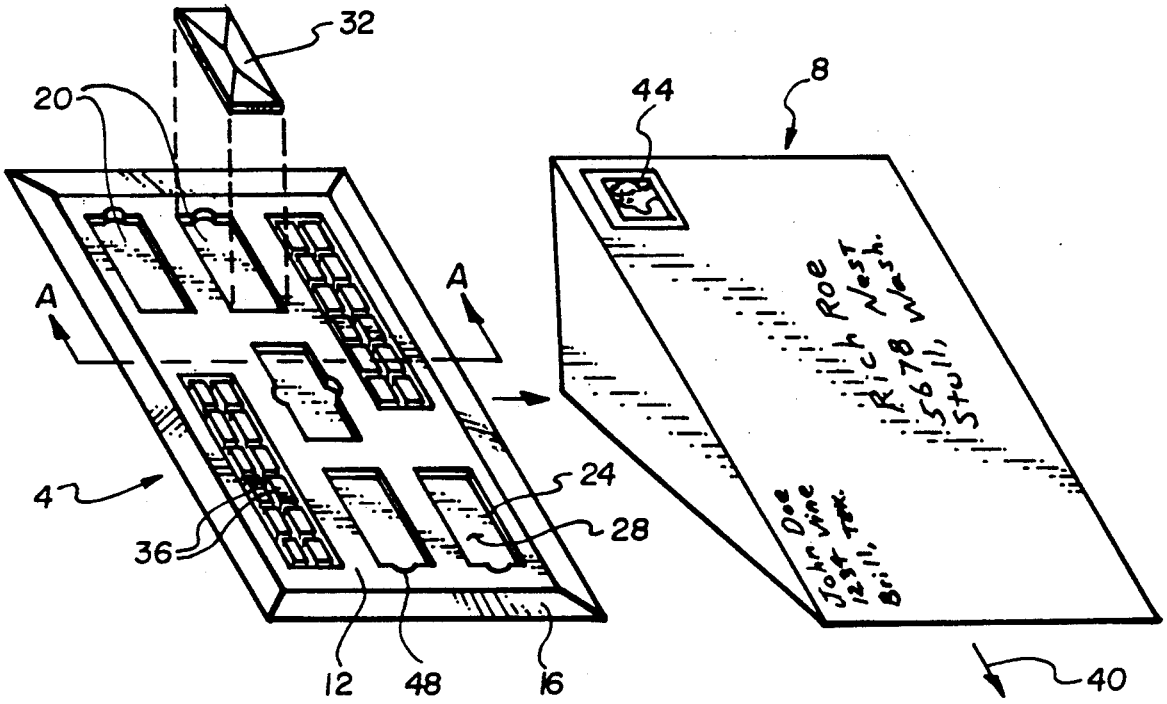
FIG. 1 is a perspective view of a confection holding structure for use in connection with greeting cards and greeting card envelopes made in accordance with the principles of the present invention.

Referring to the drawings, there is shown a mailing card/confection tray 4 constructed to have a low, generally planar profile to allow insertion and use in connection with foldable greeting cards and greeting card envelopes such as envelope 8. If used in conjunction with a greeting card, the tray 4 would be inserted between the greeting card panels and then the card would be inserted into the envelope 8.

Figure 2:
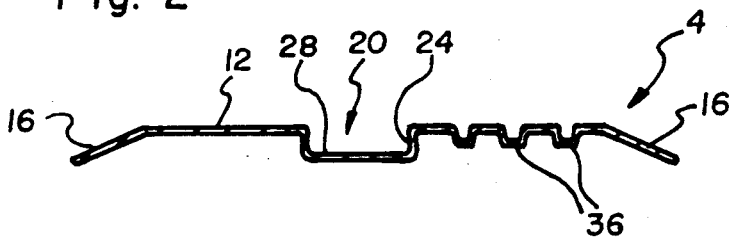
FIG. 2 is an end, cross-sectional view of the confection holding structure of FIG. 1, taken along lines A—A.

The tray 4 is formed from a sheet of material, such as polystyrene or other plastic, having a generally planar upper surface 12 (FIG. 2). The sheet of material is generally rectangular in shape and includes edges 16 which are tapered outwardly and downwardly from the upper surface 12, again as best seen in FIG. 2. The tapered edges 16 allow for easy insertion of the tray 4 into the envelope 8 and also allow for more easy movement of an envelope containing a tray through a post office stamp cancelling machine.

Also formed in the sheet of material are a plurality of shallow recesses or wells, each having sidewalls 24 which extend downwardly from the upper surface 12, and a bottom wall 28 which is generally parallel with the upper surface 12, but disposed therebelow. These recesses define receptacles for receiving and holding confections or other items such as the package indicated at 32 (FIG. 1). When the package 32 is placed in a receptacle 20, the upper surface of the package 32 is substantially flush with the upper surface 12 of the tray to thus maintain the flat profile of the tray even though confections or packages are disposed therein.

In the embodiment of the tray of FIG. 1, two of the receptacles 20 are positioned in diagonally opposite corners of the tray, and three other receptacles are arrayed generally in a line coincident with the midline of the long dimension of the tray, between the receptacles located in the corners. Of course, a variety of configurations could be employed for positioning the receptacles 20 in the tray 4.

To provide support for and prevent crushing of the receptacles 20, a plurality of downwardly extending protuberances or ridges 36 are formed in the tray 4. The depths of the ridges 36 are just less than or about the same as both the depths of the receptacles 20 and the distance downwardly which the tapered edges 16 extend. This is best seen in FIG. 2. The protuberances 36 are formed into two sets of mutually intersecting ridges which define a series of rectangles as shown. This configuration for the ridges has been found to provide desired support and crush resistance for the tray 4. The two sets of ridges 36 are positioned in diagonally opposite corners of the tray, as shown in FIG. 1. These locations for the sets of support ridges are beneficial since each receptacle 20 is adjacent to at least one set of ridges to thereby receive support from that set. Also, the positioning of the sets of support ridges as shown in FIG. 1 better protects against crushing of the receptacles when an envelope 8, with tray contained therein, is passed through a stamp cancelling machine. The envelope 8 would pass through a stamp cancelling machine in the direction indicated by the arrow 40 so that the set of support ridges of tray 4 located at the top of the envelope 8 would first be encountered by the stamp cancelling machinery prior to the machinery reaching the location of the stamp 44 where a cancellation impression would be applied.

Each of the receptacles 20 is formed with a notch 48 in a sidewall thereof to accommodate insertion of a finger therein to facilitate removal of a confection or package 32 from the receptacle.

The material of which the tray 4 might illustratively be made, although flexibly bendable, is also substantially rigid in the plane of the tray, i.e., the material of the tray cannot be readily stretched or compressed. Polystyrene and other plastics provide this characteristic.

The tray 4 may be constructed from a single piece of material by thermoforming, and thus can be readily mass produced on a fairly economical basis.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A confection holding structure for disposition in envelopes comprising a generally planar sheet of material having a plurality of relatively shallow recesses formed in one surface thereof to define open receptacles for receiving and holding confections whose thicknesses and perimetric shapes generally conform to the depths and shapes of corresponding receptacles, said sheet of material also including downwardly projecting support protuberances located generally adjacent at least some of the receptacles to thereby provide support for inhibiting crushing of the receptacles.

2. A structure as in claim 1 wherein the edges of the sheet of material are tapered outwardly and downwardly a distance substantially the same as the depths of the receptacles.

3. A structure as in claim 1 wherein the sheet of material is generally rectangular in shape to fit within a mail envelope.

4. A structure as in claim 3 wherein two of said receptacles are formed in first and second diagonally opposite corners of the sheet of material, and wherein support protuberances are formed in third and fourth diagonally opposite corners of the sheet of material.

5. A structure as in claim 4 wherein additional receptacles are formed between the support protuberances and the two receptacles, generally along the long control axis of the rectangular sheet of material.

6. A structure as in claim 5 in which in the plan view of the sheet on its side, receptacles are formed in the lower left hand corner and upper right hand corner of the sheet of material, and wherein the support protuberances are formed in the lower right hand corner and upper left hand corner.

7. A structure as in claim 2 wherein the receptacles are formed with notches on a side thereof to accommodate insertion of a finger therein to facilitate removal of confections from the receptacles.

8. A structure as in claim 2 wherein said support protuberances comprise downwardly projecting ridges formed as the perimeters of a plurality of nested rectangles.

9. A structure as in claim 2 wherein said sheet of material is substantially rigid in the height dimension thereof.

10. A structure as in claim 9 wherein said sheet of material comprises a single, unitary piece of material.

11. A structure as in claim 10 wherein said sheet of material is made of plastic, molded with said recesses and support protuberances.

12. A mailing card/confection tray for insertion in a mailing envelope comprising a sheet of material having a generally planar upper surface formed with one or more relatively shallow wells, each having sidewalls which extend downwardly from the upper surface, and a bottom wall which is generally parallel with and below the upper surface, for holding a confection, said sheet of material also having edges which taper outwardly and downwardly from the upper surface.

13. A mailing card/confection tray as in claim 12 wherein said sheet of material is formed with a plurality of support ridges which extend downwardly from the upper surface at locations generally adjacent to said wells to thereby provide structural support against pressure applied to the sidewalls of the wells.

14. A mailing card/confection tray as in claim 13 wherein the sheet of material is generally rectangular.

15. A mailing card/confection tray as in claim 14 wherein first and second wells are formed in diagonally opposite first and second corners of the sheet of material, wherein third, fourth and fifth wells are formed in series generally coincident with the midline of the long dimension of the sheet of material between the first and second wells, and wherein first and second sets of support ridges are formed in diagonally opposite third and fourth corners of the sheet of material, adjacent the first, third and fourth wells and the second, fourth and fifth wells respectively.

16. A mailing card/confection tray as in claim 15 wherein the support ridges in each set are disposed in intersecting relationship to define a series of rectangles.

17. A mailing card/confection tray as in claim 15 wherein the first and second corners of the sheet of material correspond to the upper right hand corner and lower left hand corner respectively, when viewing the sheet of material on its side in plan view.

18. A mailing card/confection tray as in claim 15 wherein the sidewalls of the wells are each formed with one or more notches into which a finger may be inserted to enable lifting an edge of a confection disposed in the corresponding well.

19. A mailing card/confection tray as in claim 15 wherein the sheet of material is substantially rigid in the plane of the material and flexibly resilient perpendicular to the plane.

20. A mailing card/confection tray as in claim 19 wherein the sheet of material is made of polystyrene.

* * * * *